United States Patent [19]

Harris et al.

[11] 4,042,379

[45] Aug. 16, 1977

[54] CONDENSATION OF ZINC VAPOR

[75] Inventors: Colin Frank Harris; Michael William Gammon, both of Bristol, England

[73] Assignees: Metallurgical Processes Ltd.; I.S.C. Smelting Limited, both of Nassau, Bahamas

[21] Appl. No.: 616,634

[22] Filed: Sept. 25, 1975

[30] Foreign Application Priority Data

Oct. 11, 1974 United Kingdom ..... 44066/74

[51] Int. Cl.[2] ..... C22B 19/04

[52] U.S. Cl. ..... 75/88

[58] Field of Search ..... 75/14, 86–88; 266/150

[56] References Cited

U.S. PATENT DOCUMENTS

| | | | |
|---|---|---|---|
| 2,473,304 | 6/1949 | Robson | 75/88 |
| 3,841,862 | 10/1974 | Benatt et al. | 75/88 |

FOREIGN PATENT DOCUMENTS

| | | | |
|---|---|---|---|
| 153,951 | 11/1953 | Australia | 75/88 |

*Primary Examiner*—M. J. Andrews

[57] ABSTRACT

Condensing zinc vapor by contacting hot gases containing zinc vapor with a spray of molten lead droplets within a multi-stage condenser with recirculation of the molten lead, wherein the temperature of the lead in an intermediate stage of the multi-stage condenser is controlled to be within the range of from 475° to 515° C, preferably by feeding hot lead from the first stage of the condenser into the intermediate stage via a duct leading through a baffle wall separating the first and intermediate stages.

7 Claims, 5 Drawing Figures

CONDENSATION OF ZINC VAPOR

BACKGROUND OF THE INVENTION

This invention relates to the condensation of zinc vapor produced in thermal reduction processes, for example in the zinc blast furnace process.

In the zinc blast furnace process, zinc vapor leaving the top of the furnace is condensed by passing it through a lead-splash condenser where the zinc vapor is contacted with an intense spray of molten lead droplets. A lead-splash condenser, when viewed schematically, approximates to a rectangular chamber provided at one end with a gas inlet duct of large cross-sectional area, this duct usually sloping downwardly to the condenser from the top of the furnace shaft, and provided at the other end with a gas outlet duct which includes a vertical or near vertical stack portion.

The intense spray of molten lead within the lead-splash condenser is generated in some suitable fashion, for example by a series of rotatable impellers immersed in a pool or pools of molten lead, in a number of separate stages.

The zinc is condensed by means of the spray of molten lead and the molten lead containing the condensed zinc flows from the condenser via an underflow baffle into a sump, known as a pump sump, from which it is transferred by a suitable pump into an elongated cooled launder. The lead is partially cooled during its passage through the launder, for example by immersion coolers, and the flowing metal, from being a one phase solution of zinc in lead, on transfer into the launder from the sump becomes a two phase system of (1) zinc containing a little lead on top of (2) lead still containing some zinc. This two phase lead/zinc system of molten metals is admitted to a separator and zinc is recovered therefrom. Cooled lead is returned to the condenser by a short launder, again via an underflow baffle.

The sensible heat of the input gases to the condenser is partially transferred to the molten lead and a thermal balance is established in the system. The factors which determine the temperatures at each end of the condenser are the gas inlet temperature and the temperature of the lead leaving the separator. There is little latitude to vary these temperatures since they are determined by the requirements for efficient operation of the blast furnace shaft and of the separator system.

The efficiency of this type of condenser system may be determined by measurement of the quantity of zinc carried out of the condenser by the gases. In conventional systems, up to about 9% of the zinc vapor entering the condenser is not recovered, and thus the condensation efficiency of such condensers may be as low as 91%.

SUMMARY OF THE INVENTION

The present invention in one aspect provides a method of condensing zinc vapor comprising contacting hot gases containing zinc vapor with a spray of molten lead droplets within a multi-stage condenser, with recirculation of the molten lead, wherein the temperature of the lead in an intermediate stage of the multi-stage condenser is controlled to be within the range of from 475° to 515° C.

The invention in another aspect provides apparatus for condensing zinc vapor comprising a multi-stage condenser including a condenser chamber divided into a series of stages, means for generating a spray of molten lead droplets within each of the stages of the condenser chamber, a recirculatory system for conveying lead out of the condenser chamber through a cooling system and back into another part of the chamber, and a lead transfer duct for transferring relatively hot molten lead to an intermediate stage of the condenser chamber to increase the lead temperature in the intermediate stage to be within the range of from 475° to 515° C.

Thus by controlling the temperature of the molten lead within an intermediate stage of a multi-stage condenser it is possible to increase the condensation efficiency of the system.

Preferably the temperature of the molten lead in the intermediate stage is between 480° and 510° C.

Preferably the intermediate stage at which the temperature is controlled is the stage immediately following the stage at which the hot gases containing zinc vapor first contact the molten lead.

In a particular preferred arrangement, the control of the lead temperature may be effected by providing an aperture in a baffle wall which divides the first stage of the condenser at which the hot gases first contact the molten lead and the intermediate stage, and by providing a duct or ducts adjacent the baffle wall at the side thereof which faces the first stage of the condenser, the duct(s) being intended to convey molten lead to the aperture in the baffle wall. Molten lead thrown against the baffle wall by the impeller or impellers in the first stage is collected in the duct(s) and is directed through the aperture in the baffle wall to the intermediate stage of the condenser.

In another possible arrangement, the control of the lead temperature may be effected by supplying relatively hot lead into the intermediate stage of the condenser. This hot lead may be part of that leaving the first stage, i.e. the stage at which the hot gases first contact the molten lead, recirculated for example via a pump sump.

In another possible arrangement, the control of the lead temperature can be effected by transferring some of the cooler lead already cooled for supply to or already in the last stage of the condenser to an earlier condenser stage, whereby the temperature is increased in the intermediate condenser stage by virtue of decreased cooler lead flow therein. The transferred cooler lead is preferably that leaving the cooling launders after being recirculated from the stage at which hot gases first contact the molten lead. Cooled lead for such transfer could conveniently be obtained after separation of the zinc content.

BRIEF DESCRIPTION OF THE DRAWINGS

The invention will be further described, by way of example only, with reference to the accompanying drawings, in which.

DETAILED DESCRIPTION OF THE PREFERRED EMBODIMENT

Figure 1:
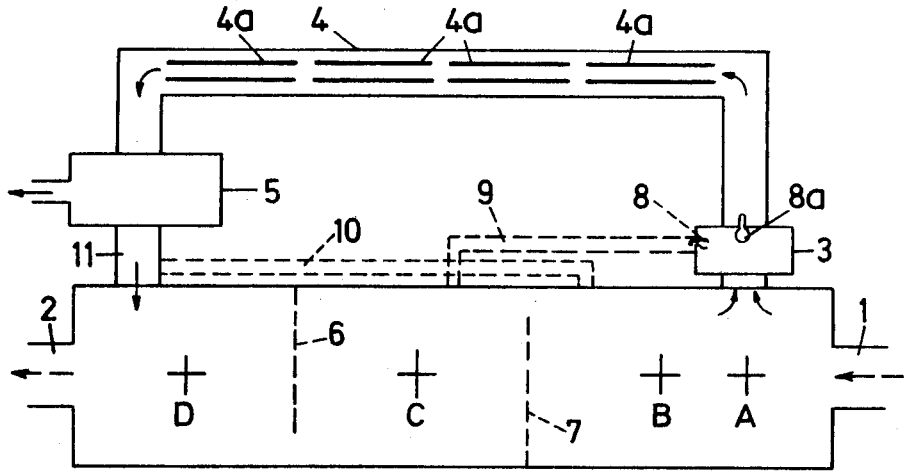
FIG. 1 is a schematic plan view of a three-stage lead splash condenser.
Figure 2:
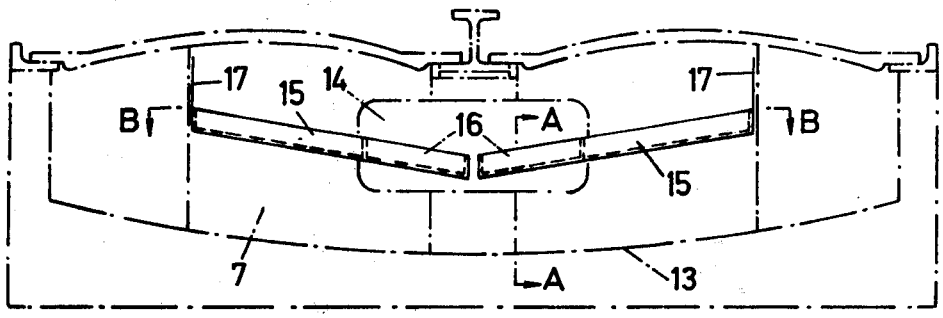
FIG. 2 is a schematic side view of a part of a multi-stage lead splash condenser and shows a particular form of duct for transferring lead between adjacent stages of the condenser.
Figure 3:
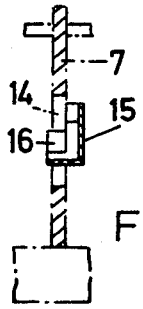
FIGS. 3 and 4 are sections taken along the lines A—A and B—B respectively in FIG. 2.
Figure 4:
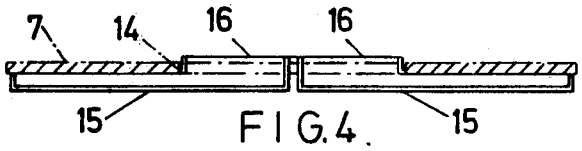
Figure 5:
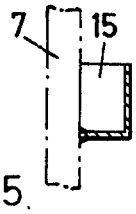
FIG. 5 is a side view illustrating the position of the duct in FIG. 2.

The condenser shown in FIG. 1 comprises a rectangular chamber having a gas inlet 1 and a gas outlet 2. The condenser is fitted with four impellers indicated as A, B, C and D and the interior of the condenser is divided into three stages by vertical baffles 6 and 7 which serve to break up the gas flow within the condenser chamber. The stage in which are located the impellers A and B is designated as the first stage, that in which is located the impeller C is designated the intermediate stage, and that in which is located the impeller D is designated the final stage.

The impellers A, B, C and D are immersed in pools of molten lead and are employed in order to throw up an intense spray of molten lead droplets within the condenser. Molten lead leaving the condenser flows via an underflow baffle into a pump sump 3, from which the lead is transferred by means of a suitable pump 8*a* into an elongated launder 4 having cooling means 4*a* therein. On cooling, a layer of zinc separates out on the surface of the molten lead, and the zinc is separated in a separator 5, the cooled lead being returned to the condenser chamber by a short launder 11 via an underflow baffle.

In one particular arrangement, the control of the lead temperature in the intermediate stage may be effected by placing a second, variable-output pump 8 in the pump sump 3, and connecting this via a short launder 9 which passes to the intermediate condenser stage. Alternatively, some hot lead could be directed from the upstream ends of the main launder 4 prior to cooling, but the use of a second pump is easier to control. Thus, in this arrangement, relatively hot lead may be directly transferred to the intermediate stage.

Control of the pump can be achieved in several ways, for example by providing a temperature sensing device in the condenser and in the sump and by adjusting the pump speed automatically. Alternatively, control of the pump can be achieved by simple manual periodic adjustments of the pump speed as indicated by a direct reading temperature sensor located in the intermediate stage.

In an alternative arrangement, some of the lead may be transferred from the return launder 11 downstream of the separator 5 via a launder 10, so that relatively cold lead is added to the first stage of the condenser. The reduced flow of relatively cool lead into the intermediate stage causes the temperature therein to increase. Cooled lead could also conceivably be pumped from upstream of the separator 5 or even directly from the final stage to the first stage of the condenser.

Although the two arrangements just described are possible practical embodiments, it is most preferred to effect control of the lead temperature by means of the arrangement shown in FIGS. 2 to 5.

In the arrangement shown in FIGS. 2 to 5, the vertical baffle 7 which extends between the roof 12 and floor 13 of the condenser is provided with a centrally located aperture 14. Two downwardly sloping ducts 15 are attached to the baffle wall 7 on the side thereof which faces the first stage of the condenser. A chute 16 is provided at the lowermost end of each duct 15 to assist in directing molten lead through the aperture 14. Curved plates are provided to guide the lead running from the lowermost end of each duct into the chutes 16 so that a smooth flow of lead is achieved from the ducts through the aperture in the baffle wall 7. A vertical end baffle 17 is provided at the uppermost end of each duct to direct lead flow into the ducts. Molten lead thrown against the baffle wall 7 by the impellers located in the first stage of the condenser is collected in the ducts 15 and is directed through the aperture 14 in the baffle wall to the intermediate stage of the condenser. Typically the ducts 15 may be about 6 inches deep and the vertical end baffles 17 may be of a similar depth.

In the arrangement shown in FIGS. 2 to 5, the temperature adjustment is thus effected by the direct transfer of hot lead from the first stage of the condenser to the cooler intermediate stage. The optimum temperature in the intermediate stage is 510° C, i.e. about 45° higher than is attainable in a conventional lead splash condenser. It has been found possible to approach the optimum temperature in the intermediate stage of the condenser by recycling between 1500 and 2000 tons per hour, more preferably about 1800 tons per hour, of molten lead between the first and intermediate stages.

It is possible to apply ancillary heating to the intermediate stage of the condenser, for example by arranging a burner below the intermediate stage. Additionally, the intermediate stage may be lagged to retain its heat.

To condense zinc from a blast furnace having a shaft area of 185 feet either a single condenser may be employed, or a pair of condensers may be used to condense zinc from a divided gas stream. The usual lead circulation rate for the single condenser is in the region of 3000 tons per hour for the specified shaft, or, alternatively, when a pair of condensers are employed the circulation rate for each is in the region of 1500 tons per hour of molten lead.

Referring to FIG. 1, the normal distribution of lead temperatures is as follows (that is, without any recirculation between the stages):

Impeller A — about 600° C
Impeller B — about 520° C
Impeller C — about 465° C
Impeller D — about 450° C
Pump Sump — about 560° C In the case of a large condenser circulating 3000 tons per hour of molten lead a recirculation rate of 1800 tons per hour between the first and intermediate stages results in an increase in the lead temperature at the intermediate stage to approximately 495° to 500° C.

While the invention has been described above with reference to a lead splash condenser containing a number of rotary impellers, the invention is equally applicable to the type of spray condenser described in our British patent specification No. 1,359,677 in which pairs of jets are spaced along the condenser roof to produce sprays by the mutual impingement of streams of molten lead.

We claim:

1. A method of condensing zinc vapor comprising, in combination, the steps of: continuously passing hot gases containing zinc vapor successively through at least three condensation chambers from a first chamber to a last chamber; continuously passing molten lead countercurrently to the hot gases successively through the condensation chambers from the last chamber to the first chamber; continuously generating a spray of molten lead droplets in each of the condensation chambers by rotating at least one impeller immersed in molten lead in each of the condensation chambers to condense the zinc vapor; continuously recycling molten lead from the first chamber to the last chamber comprising the steps of exiting molten lead containing condensed zinc from the first chamber, cooling the exiting molten lead containing the condensed zinc, separating the condensed zinc from the cooled molten lead and feeding the cooled molten lead to the last condensation chamber; and continuously recycling to a chamber intermediate the first chamber and the last chamber, molten lead at a temperature greater than the temperature of the molten lead in the intermediate chamber, to increase the temperature of the molten lead in the intermediate chamber to within the range of from 475° to 515° C.

2. The method according to claim 1 wherein the step of recycling the molten lead to the intermediate chamber comprises feeding some of the molten lead exiting from the first chamber, prior to cooling, to the intermediate chamber.

3. The method according to claim 1 wherein the temperature of the lead in the intermediate chamber is increased to be within the range of from 480° to 510° C.

4. The method according to claim 1 wherein the intermediate chamber is the chamber immediately following the first chamber at which the hot gases containing zinc vapor first contact the molten lead.

5. The method according to claim 2 wherein the step of recycling the molten lead from the first chamber to the intermediate chamber comprises channeling some of the sprayed molten lead droplets in the first chamber to the intermediate chamber.

6. A method of condensing zinc vapor comprising, in combination, the steps of: continuously passing hot gases containing zinc vapor successively through at least three condensation chambers from a first chamber to a last chamber; continuously passing molten lead countercurrently to the hot gases successively through the condensation chambers from the last chamber to the first chamber; continuously generating a spray of molten lead droplets in each of the condensation chambers by rotating at least one impeller immersed in molten lead in each of the condensation chambers to condense the zinc vapor; continuously recycling molten lead from the first chamber to the last chamber comprising the steps of exiting molten lead containing condensed zinc from the first chamber, cooling the exiting molten lead containing the condensed zinc, separating the condensed zinc from the cooled molten lead and feeding the cooled molten lead to the last condensation chamber; and continuously recycling some of the cooled molten lead to the first chamber to increase the temperature of the molten lead in the intermediate chamber to within the range of from 475° to 515° C due to a decreased flow of the cooled molten lead in the intermediate chamber.

7. The method according to claim 6 wherein the step of recycling the cooled molten lead to the first chamber comprises feeding some of the cooled molten lead, after separation of the condensed zinc, to the first chamber.

* * * * *

UNITED STATES PATENT AND TRADEMARK OFFICE

CERTIFICATE OF CORRECTION

PATENT NO. : 4,042,379

DATED : August 16, 1977

INVENTOR(S) : Colin F. Harris, et al

It is certified that error appears in the above-identified patent and that said Letters Patent are hereby corrected as shown below:

[73] Assignment:

Metallurgical Processes Limited and I.S.C. Smelting Limited carrying on business together in the Bahamas under the name and style of Metallurgical Development Company Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*